US010350468B2

(12) United States Patent
Hebreo et al.

(10) Patent No.: US 10,350,468 B2
(45) **Date of Patent: *Jul. 16, 2019**

(54) GOLF CLUB HAVING STRIKING FACE WITH SUPPORTING WALL

(71) Applicant: Acushnet Company, Fairhaven, MA (US)

(72) Inventors: Jonathan Hebreo, San Diego, CA (US); Nick Frame, Vista, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/844,286

(22) Filed: Dec. 15, 2017

(65) Prior Publication Data

US 2018/0104552 A1 Apr. 19, 2018

Related U.S. Application Data

(63) Continuation-in-part of application No. 15/184,688, filed on Jun. 16, 2016, now Pat. No. 10,065,088.

(51) Int. Cl.

| | |
|---|---|
| ***A63B 53/04*** | (2015.01) |
| ***A63B 60/52*** | (2015.01) |
| *A63B 60/54* | (2015.01) |

(52) U.S. Cl.

CPC ..... *A63B 53/0475* (2013.01); *A63B 53/0466* (2013.01); *A63B 60/52* (2015.10); *A63B 60/54* (2015.10); *A63B 2053/0416* (2013.01); *A63B 2053/0433* (2013.01); *A63B 2209/00* (2013.01)

(58) Field of Classification Search

CPC ..... A63B 2053/0416; A63B 2053/042; A63B 2053/0425; A63B 2053/0429; A63B 2053/0454; A63B 2053/0458; A63B 53/047

USPC ..... 473/324–350, 287–292

See application file for complete search history.

(56) References Cited

U.S. PATENT DOCUMENTS

| | | | | |
|---|---|---|---|---|
| 4,884,812 | A * | 12/1989 | Nagasaki | A63B 53/04 473/342 |
| 5,083,778 | A | 1/1992 | Douglass | |
| 5,288,070 | A * | 2/1994 | Chen | A63B 53/04 473/331 |
| 5,295,689 | A | 3/1994 | Lundberg | |
| 5,398,929 | A | 3/1995 | Kitaichi | |
| 5,839,975 | A | 11/1998 | Lundberg | |
| 5,863,261 | A | 1/1999 | Eggiman | |
| 6,074,309 | A | 6/2000 | Mahaffey | |
| 6,299,547 | B1 | 10/2001 | Kosmatka | |
| 6,743,117 | B2 * | 6/2004 | Gilbert | A63B 53/047 473/332 |
| 6,918,841 | B2 * | 7/2005 | Chen | A63B 53/04 473/342 |
| 6,964,620 | B2 | 11/2005 | Gilbert | |
| 7,056,229 | B2 | 6/2006 | Chen | |
| 7,247,104 | B2 | 7/2007 | Poynor | |
| 7,281,990 | B2 | 10/2007 | Hagood | |

(Continued)

*Primary Examiner* — Sebastiano Passaniti

(57) ABSTRACT

A golf club head has a striking face. A ledge extends from the perimeter contact rim of the golf club head. The striking face is secured to the club head body proximate the rim. There is a gap between the striking face and the ledge. The inner wall's perimeter edge is disposed in the gap and is in contact with the ledge. The rear surface of the striking face is in contact with a portion of the inner wall.

17 Claims, 15 Drawing Sheets

(56) References Cited

U.S. PATENT DOCUMENTS

| | | | | |
|---|---|---|---|---|
| 7,582,024 | B2 | 9/2009 | Shear | |
| 7,651,408 | B2 | 1/2010 | Hagood | |
| 7,662,051 | B2 | 2/2010 | Chen | |
| 8,016,691 | B2 | 9/2011 | Stites | |
| 8,475,293 | B2 | 7/2013 | Morin | |
| 8,801,540 | B2 | 8/2014 | Hebreo et al. | |
| 8,911,301 | B1 | 12/2014 | Allen | |
| 9,138,622 | B1 | 9/2015 | DeMille | |
| 9,199,141 | B2 * | 12/2015 | Cardani | A63B 53/047 |
| 9,457,241 | B2 | 10/2016 | Hebreo | |
| 9,474,945 | B2 | 10/2016 | Fossum | |
| 10,065,088 | B2 * | 9/2018 | Hebreo | A63B 53/047 |
| 2003/0190975 | A1 | 10/2003 | Fagot | |
| 2004/0266545 | A1 | 12/2004 | Gilbert | |
| 2006/0154743 | A1 * | 7/2006 | Huang | A63B 53/0466 473/345 |
| 2010/0273565 | A1 | 10/2010 | Stites | |
| 2013/0196785 | A1 * | 8/2013 | Takechi | A63B 53/0466 473/332 |
| 2017/0361177 | A1 | 12/2017 | Hebreo et al. | |
| 2018/0236324 | A1 | 8/2018 | Hebreo | |

* cited by examiner

GOLF CLUB HAVING STRIKING FACE WITH SUPPORTING WALL

CROSS-REFERENCE TO RELATED APPLICATIONS

This application is a continuation-in-part of U.S. patent application Ser. No. 15/184,688, filed Jun. 16, 2016, entitled "Golf Club Having Double-Walled Striking Face," the disclosure of which is hereby incorporated by reference herein in its entirety.

BACKGROUND

It is a goal for golfers to reduce the total number of swings needed to complete a round of golf, thus reducing their total score. To achieve that goal, golfers may often desire to hit a golf ball a long distance. The distance the golf ball travels depends on both the skill of the golfer and the equipment used by the golfer. With respect to the golf club, the construction of a striking face, along with other elements of the club, has an effect on the outgoing speed of a ball when struck by the club. For example, as the striking face contacts the golf ball, the striking face may provide a spring-like effect, adding to the speed of the golf ball as it leaves the club face.

SUMMARY

In one aspect, the technology relates to a golf club head having a striking face; a club head body having a perimeter contact rim and a ledge extending from the perimeter contact rim, wherein the striking face is secured to the club head body proximate the perimeter contact rim, and wherein the ledge is spaced from a rear surface of the striking face so as to define a gap therebetween; and an inner wall has a perimeter edge, wherein at least a portion of the perimeter edge is disposed in the gap and in contact with the ledge, and wherein the rear surface of the striking face is in contact with a portion of the inner wall. In an example, the ledge extends inward from the perimeter contact rim, and wherein the ledge is offset from the perimeter contact rim, and wherein the inner wall is substantially parallel to the striking face. In another example, the perimeter edge is tapered. In yet another example, the club head body further includes a sole, a topline, a heel, and a toe, and wherein the ledge is disposed proximate at least one of the sole, the topline, the heel, and the toe. In still another example, the perimeter edge is in contact with a portion of the ledge disposed proximate the topline and the sole.

In another example of the above aspect, a heel portion of the perimeter edge is unsupported by the ledge when the striking face is in a neutral position. In an example, the heel portion of the perimeter edge is in contact with a lip when the striking face is in a deflected position. In another example, the perimeter edge of the inner wall has a shape substantially similar to a perimeter edge of the striking face.

In another aspect, the technology relates to a golf club head having: a body portion having a perimeter contact rim and a ledge extending inward from the at least a portion of the perimeter contact rim, wherein the ledge is discrete from the perimeter contact rim; an inner plate having an edge and a central portion, wherein at least a portion of the edge is in contact with the ledge; and a striking face secured to the perimeter contact rim, wherein a rear surface of the striking face is in contact with the central portion of the inner plate when the striking face is in a neutral position. In an example, the rear surface of the striking face is in contact with the central portion of the inner plate when the striking surface is in a deflected position. In another example, the edge of the inner plate is tapered and wherein when in the deflected position, the rear surface of the striking face and the perimeter edge of the inner plate define a space therebetween. In yet another example, the inner plate includes a topline edge, a sole edge, and a heel edge, and wherein when the striking surface is in a neutral position, the topline edge and the sole edge are in contact with the ledge. In still another example, when the striking surface is in a deflected position, (a) the topline edge and the sole edge are in contact with the ledge, and (b) the heel edge is in contact with a lip extending from the club head body.

In another example of the above aspect, the striking face is secured about the perimeter contact rim. In an example, the body portion includes a topline edge, a sole edge, a heel edge, and a toe edge, and wherein the ledge extends along substantially the entire length of at least one of the topline edge, the sole edge, the heel edge, and the toe edge. In another example, the ledge has two ledges, wherein the two ledges are disposed proximate opposing edges of the perimeter contact rim.

In another aspect, the technology relates to a golf club head having: a club head body having a perimeter contact rim and a ledge extending inward from at least two opposing edges of the perimeter contact rim; a striking face connected to the club head body proximate the perimeter contact rim; and an inner wall having a central portion defining a central area and an edge surrounding the central portion and defining an edge area less than the central area, wherein the edge is in contact with the ledge, and wherein a rear surface of the striking face contacts the central portion and is spaced apart from the edge when the striking face is in both a neutral position and a deflected position. In an example, a distance between the edge and the rear surface of the striking face in the neutral position is greater than a distance between the edge and the rear surface of the striking face in the deflected position. In another example, the central area includes an area approximately 78% of the a total area of the inner wall. In yet another example, the striking face and the inner wall have substantially similar perimeter shapes.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head, such as an iron, fairway metal, driver, or other golf club head, that includes a double-walled striking face, e.g., a golf club head having an inner wall structure in contact with an outer striking face. In examples, such club heads may include a sole channel. One end of the inner wall structure is fixed to the golf club head, while another end of the inner wall structure is unfixed, allowing the inner wall structure to slide against a rear surface of the striking face. Such an inner wall structure contributes to a spring effect of the striking face, thus improving ball speed and launch characteristics from strikes near the center and top of the striking face. The golf club head may also include a sole channel that creates improved ball speed and launch characteristics for strikes near the center and bottom of the striking face. Accordingly, the use of the double-walled striking face and the sole channel in tandem provide improved launch characteristics, such as launch angles, spin characteristics, and ball speed, across the entire striking face, from the topline to the sole. Thus, both shots from the turf and off a tee produce improved launch characteristics.

Figure 1B:
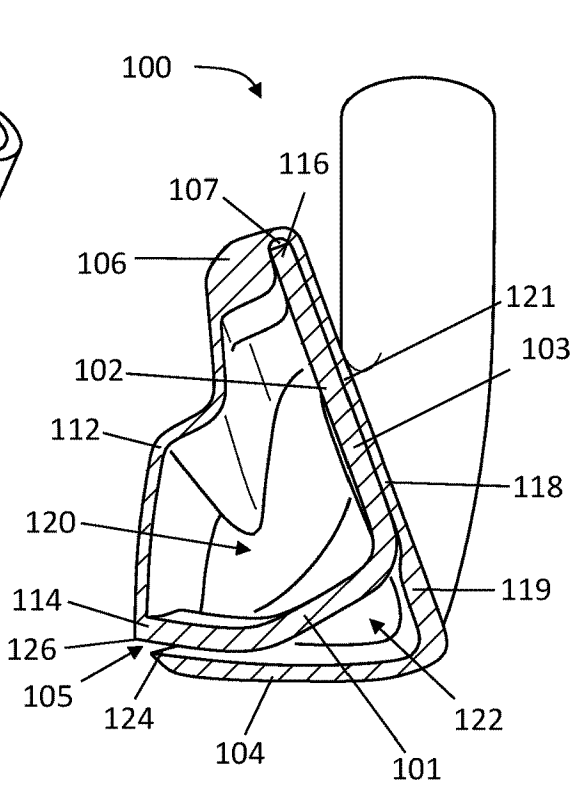
FIG. 1B depicts a section view of an example of a golf club head having a double-walled striking face and a sole channel.
Figure 1A:
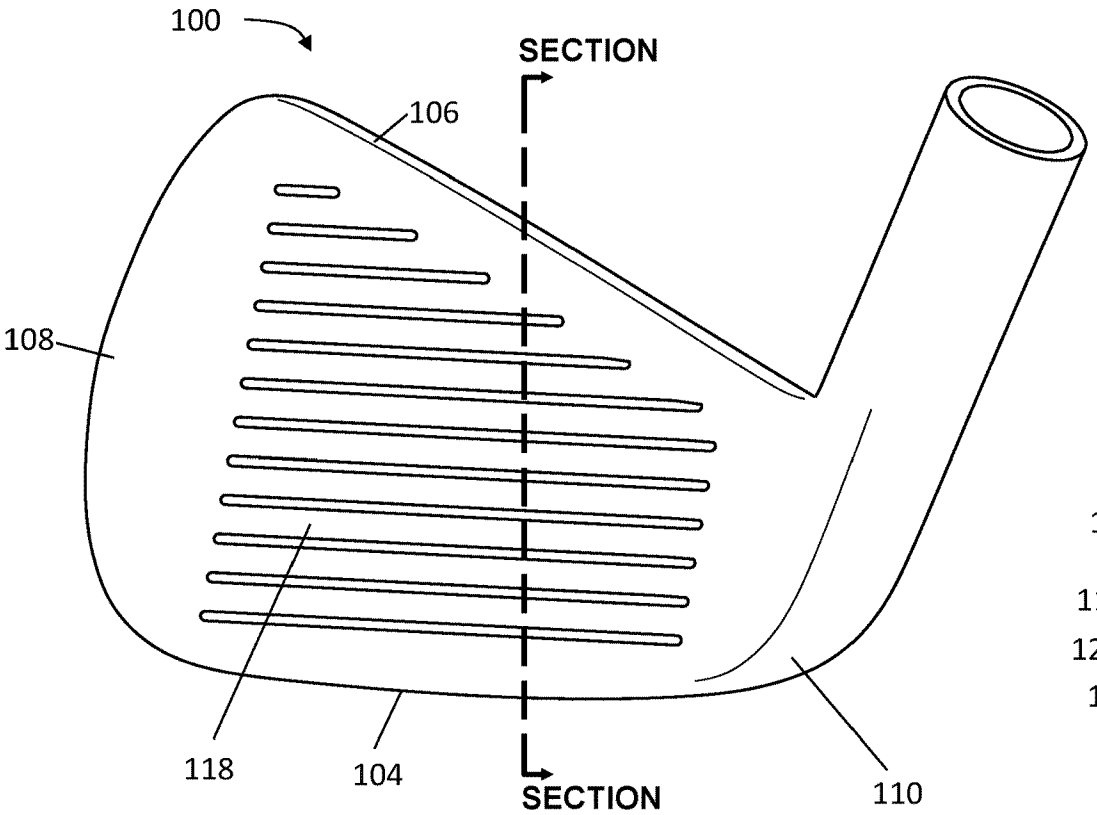
FIG. 1A depicts a perspective view of a golf club.

FIG. 1A depicts a perspective view of a golf club head 100 having an inner wall structure 102 and a sole channel 105, and FIG. 1B depicts a section view of the golf club head 100. FIGS. 1A-1B are described concurrently. The golf club head 100 includes striking face 118 attached to a sole portion 104, a toe portion 108, a topline 106, and a heel portion 110. The topline 106 is also attached to a back portion 112. The inner wall structure 102 extends from the back portion 112 towards the striking face 118, and a first cavity 120 is partially defined (in section) by the back portion 112, the topline 106, and the inner wall structure 102. The inner wall structure 102 includes a fixed end 114, attached to the back portion 112, and an unfixed end 116. The fixed end 114 may be attached to the back portion 112 via welding, brazing, or fastening, such as with screws or rivets, along with any other suitable attachment methods. The unfixed end 116 is received by a recess 107 in an internal portion of the topline 106. The recess 107 is shaped or configured so as to receive, but not fix or secure, the unfixed end 116 of the inner wall structure 102, such that the unfixed end 116 may move freely therefrom. The inner wall structure 102 also includes a support portion 101 and a contact portion 103. The support portion 101 supports the contact portion 103, which is in contact with a rear surface of the striking face 118. In the example depicted, the support portion 101 generally has an angled v-shape from the back portion 112 to the striking face 118, and a component of the support portion 101 extends substantially orthogonal to the striking face 118. The contact portion 103 runs substantially parallel to the striking face 118. Lubrication may be disposed between the contact portion 103 and the striking face 118 so as to reduce the friction between those elements. This allows for easier sliding of the surfaces against one another. Further, in some examples, additional machining or processing is performed on these contacting elements to create extra-smooth surfaces to further reduce friction therebetween. The contact portion 103 may also be coated with a polymer, such as a TEFLON-brand coating available from E. I. duPont de Nemours and Company of Wilmington, Del., or other similar materials for management of vibrations, friction, and alteration of sound properties emitted upon striking a golf ball.

The striking face 118 may also have multiple thicknesses, including a thick portion 119 and a thin portion 121. The thick portion 119 has a thickness greater than a thickness of the thin portion 121. Because the inner wall structure 102 provides additional support to the thin portion 121, the thin portion 121 may be thinner than it would otherwise be in the absence of the inner wall structure 102. In an example, the thick portion 119 has a thickness that is approximately double the thickness of the thin portion 121. In one example, the thin portion 121 may have a thickness of approximately 0.9 mm and the thick portion 119 may have a thickness of approximately 1.4 mm.

The thickness of the contact portion 103 and the thin portion 121 of the striking face 118 may also differ. For example, the contact portion 103 may have a thickness that is approximately double the thickness of the thin portion 121 of the striking face 118. In some examples, the ratio of the thickness of the contact portion 103 to the thickness of the thin portion 121 of the striking face 118 may be approximately 1.5:1, 2.5:1, or 3:1. In other examples, the thickness of the contact portion 103 may be approximately the same as that of the thick portion 119 of the striking face 118.

The types of materials used to create the inner wall structure 102 and the striking face 118 may also differ. As an example, the inner wall structure 102 may be made of a low-density material with a high strength, while the striking face 118 may be made of a material with a relatively higher density and a relatively lower strength. As another example, the striking face 118 may be made from a material having a low elastic modulus while the inner wall structure 102 may be made form a material having a relatively higher elastic modulus. For instance, the striking face 118 may be made from a steel material and the inner wall structure 102 may be made from a titanium material. In another instance, the inner wall structure 102 may be made from a high-strength steel, such as maraging C350 steel, and the striking face 118 may be made from a lower strength steel, such as maraging C300 steel. In the above examples using different types of materials, the thickness of the contact portion 103 may be approximately the same as the thickness of the thin portion 121 of the striking face 118. Such materials may also be coated with a polymer for damping vibration and managing friction between surfaces. For instance, the contact portion 103 could be coated with a low-friction polymer.

The golf club head 100 may also include a sole channel 105. The sole channel 105 includes a front edge 124 and a back edge 126. The sole channel 105 may extend from near the heel portion 110 to the toe portion 108 and may be substantially the same width as the striking face 118. In the example depicted, the sole channel 105 separates the back portion 112 from the sole portion 104. The fixed end 114 of the inner wall structure 102 is attached to the back portion 112 at the back edge 126. The sole channel 105 defines a through-hole into a second cavity 122 that is partially defined (in section) by the thick portion 119, the sole portion 104, and the inner wall structure 102. In some examples, the sole channel 105 is filled with or spanned by a polymer or other elastic material to prevent debris from entering the second cavity 122. The incorporation of the sole channel 105 allows for further deflection of lower portions of the striking face 118, thus providing additional ball speed from golf ball strikes occurring in lower regions of the striking face 118.

Figure 1D:
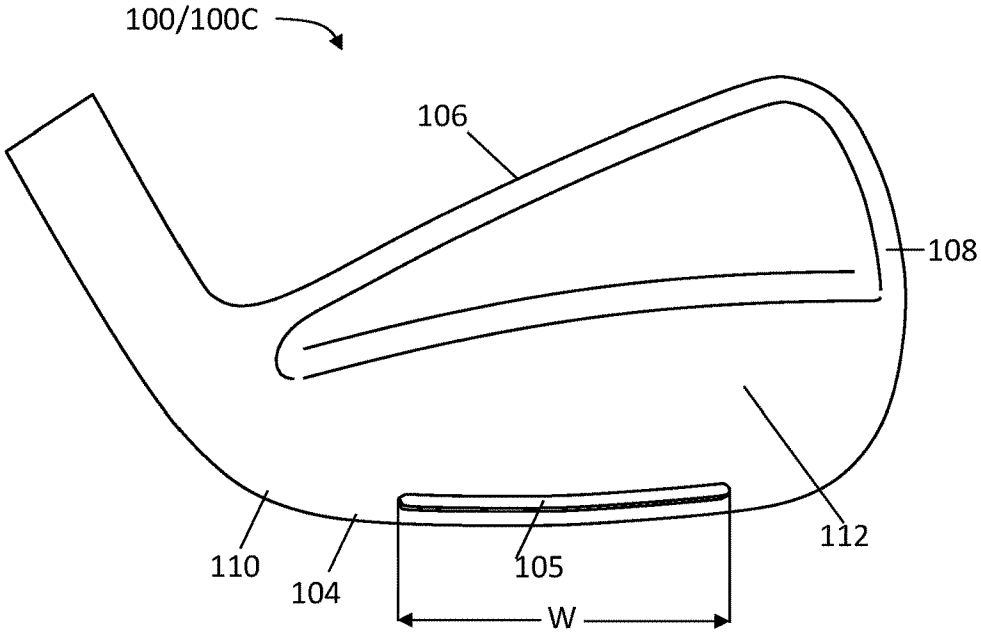
FIG. 1D depicts a back view of the golf club head depicted in FIGS. 1A-1C.
Figure 1C:
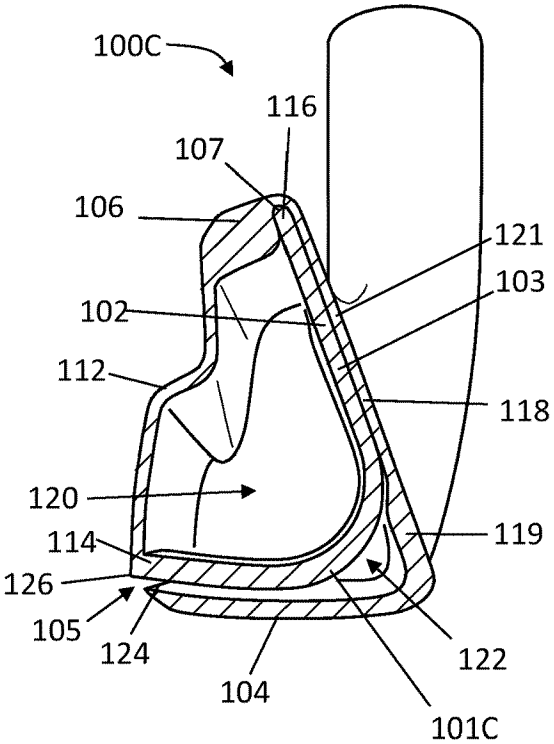
FIG. 1C depicts a section view of another example of a golf club head having a double-walled striking face and a sole channel.

FIG. 1C depicts a section view of another example of a golf club head 100C having an inner wall structure 102 and a sole channel 105. The golf club head 100C is substantially the same as the golf club head 100 depicted in FIG. 1B and, as such, not all element thereof are described further. In golf club head 100C, however, the support portion 101C has a curved C-shape. The curved C-shape of support portion 101C allows for more deflection of the striking face 118 and the contact portion 103 because the component of the curved C-shape that is orthogonal to the striking face 118 is reduced in size.

FIG. 1D depicts a back view of the golf club heads 100, 100C depicted in FIGS. 1A-1C. The sole channel 105 runs across a bottom side of the back portion 112 in a direction substantially parallel to the striking face 118. In the example depicted, the sole channel 105 separates a portion of the sole portion 104 from the back portion 112. In some embodiments, the sole channel 105 may have a width W that is approximately the same as the width of the striking face 118 and/or the width of the inner wall structure 102. In other examples, the width W of the sole channel 105 is approximately the same as the diameter of a golf ball (i.e., about 1.6-1.7 inches) or greater. As discussed above, the sole channel 105 may also be filled with or spanned by an elastic material.

Figure 2A:
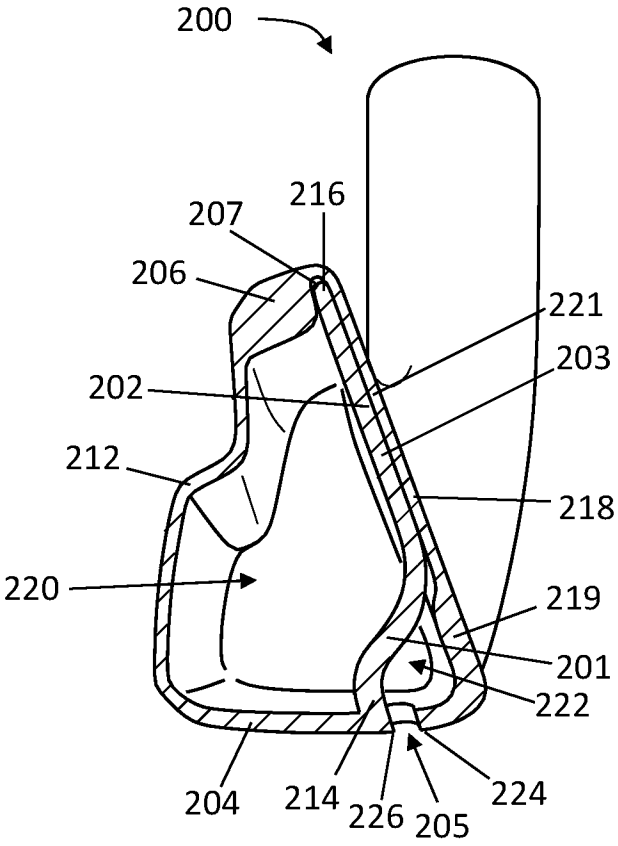
FIG. 2A depicts a section view of another example of a golf club head having a double-walled striking face and a sole channel.
Figure 2B:
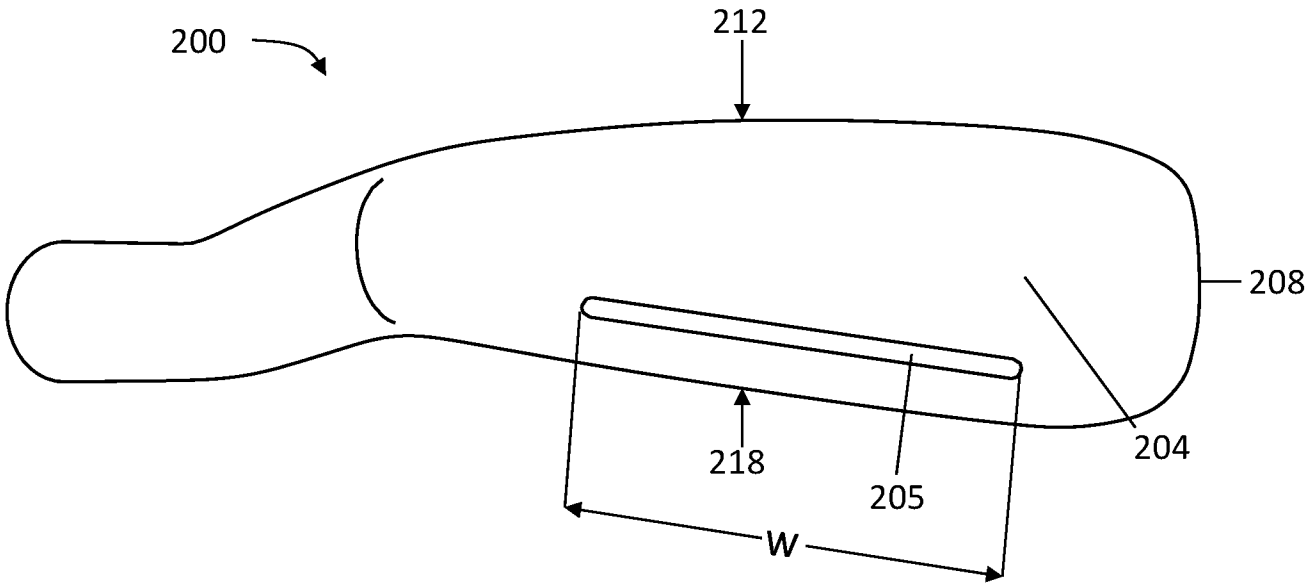
FIG. 2B depicts a bottom view of the golf club head of FIG. 2A.

FIGS. 2A-2B depict a section view and a bottom view, respectively, of another golf club head 200 and are described concurrently. The golf club head 200 is similar to the golf club heads 100, 100C depicted in FIGS. 1A-1C and described above. As such, elements common to both configurations are numbered similarly, but are not necessarily described further. An inner wall structure 202 includes a support portion 201, a contact portion 203, a fixed end 214, and an unfixed end 216. The support portion 201 has a curved S-shape and the contact portion 203 is substantially parallel to the striking face 218. The striking face 218 may also include a thick portion 219 and a thin portion 221. Two cavities are also formed: a first cavity 220 and a second cavity 222.

The sole channel 205 is located proximate to the striking face 218. By moving the sole channel 205 closer to the striking face 218, the deflection of the thick portion 219 of the striking face 218 is increased when striking a golf ball. The back edge 226 of the sole channel 205 is formed by a rear segment of the sole portion 204 and the front edge 224 of the sole channel 205 is formed by a front segment of the sole portion 204. Because less of the sole portion 204 is directly attached to the striking face 218, there is less resistance to deflection of the thick portion 219. Accordingly, the increased deflection may provide for increased ball speeds resulting from ball strikes occurring near the thick portion 219 of the striking face 218. The sole channel 205 may also run substantially parallel to the striking face 218, as shown in FIG. 2B. The sole channel 205 may also be filled with or spanned by an elastic material.

Figure 3:
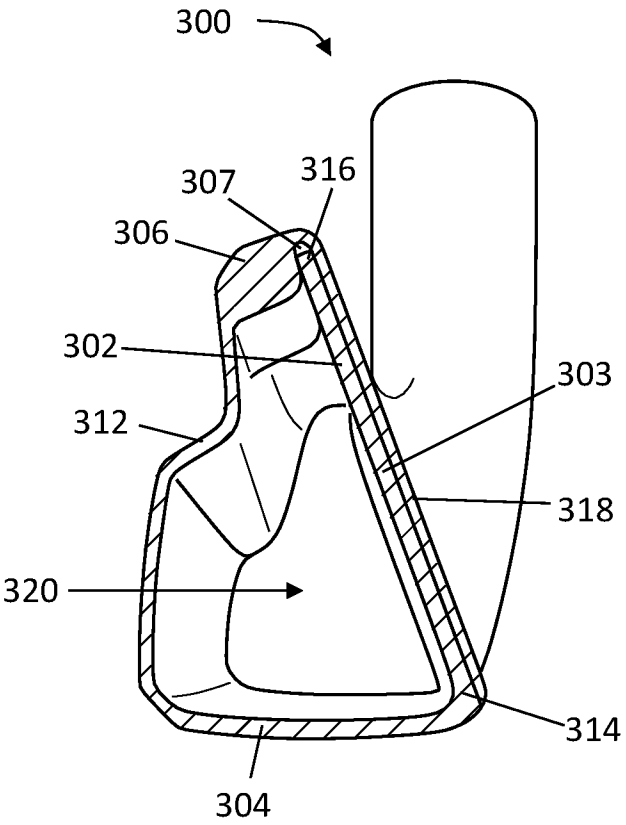
FIG. 3 depicts a section view of another example of a golf club head having a double-walled striking face.

FIG. 3 depicts another example of a golf club head 300. The golf club head 300 is similar to golf club heads described above, and as such, elements common to those configurations and the golf club head 300 are numbered similarly, but are not necessarily described further. The golf club head 300 includes a striking face 318 that is attached to the topline 306, the toe portion 308 and the heel portion 310, but is at least partially not attached to the sole portion 304. Accordingly, the striking face 318 is effectively hinged at the topline 306 allowing for movement of the striking face 318. In other embodiments, the striking face 318 may also not be directly attached to the toe portion 308 or the heel portion 310.

The inner wall structure 302 includes a fixed end 314 and an unfixed end 316. The fixed end 314 is attached to a front edge of the sole portion 304 directly behind the striking face 318. The inner wall structure 302 may not include a support portion, as the entire inner wall structure 302 is in contact with the rear surface of the striking face 318. In some examples, however, the inner wall structure 302 may include a small support portion to allow for attachment to the sole portion 304 via welding or other fastening measures. Unlike the embodiments depicted above, only a single cavity 320 is present.

The inner wall structure 302 and the striking face 318 are fixed, or effectively hinged, at opposite portions of the golf club head 300. More specifically, in the example depicted, the inner wall structure 302 has a fixed end 314 at the sole portion 304 and an unfixed end 316 near the topline 306, and the striking face 318 has a fixed end at the topline 306 and an unfixed end near the sole portion 304. Such a configuration allows the inner wall structure 302 to slide against the rear surface of the striking face 318 and also to deflect separately from the striking face 318. For example, upon a strike of a golf ball, the striking face 318 moves in an upward direction while the inner wall structure 302 moves downward.

In other examples, the fixed and unfixed ends of the inner wall structure 302 and the striking face 318 may be inverted from the example depicted in FIG. 3. That is, the inner wall structure 302 may have a fixed end at the topline 306 and an unfixed end near the sole portion 304, and the striking face 318 may have a fixed end at the sole portion 304 and an unfixed end near the topline 306. In yet other examples, the inner wall structure 302 may have a fixed end at the toe portion 308 and an unfixed end near the heel portion 310, and the striking face 318 may have a fixed end at the heel portion 310 and an unfixed end near the toe portion 308, or vice versa.

Further, because substantially the entire rear surface of the striking face 318 is in contact with the inner wall structure 302, the thickness of the striking face 318 may be uniform. The thickness of the striking face 318 may also be less than the thickness of the inner wall structure 302, and the striking face 318 and the interior wall structure 302 may also be made of different materials.

Figure 4A:
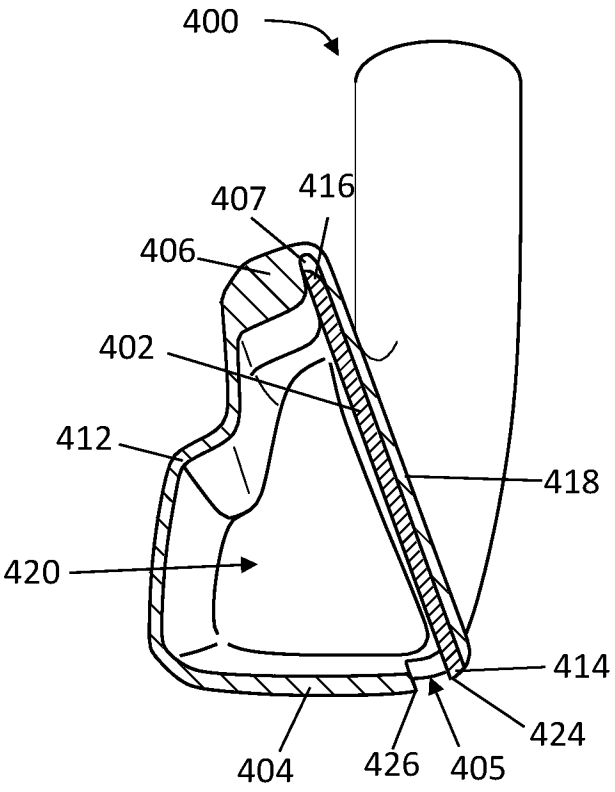
FIG. 4A depicts a section view of another example of a golf club head having a double-walled striking face and a sole channel.
Figure 4B:
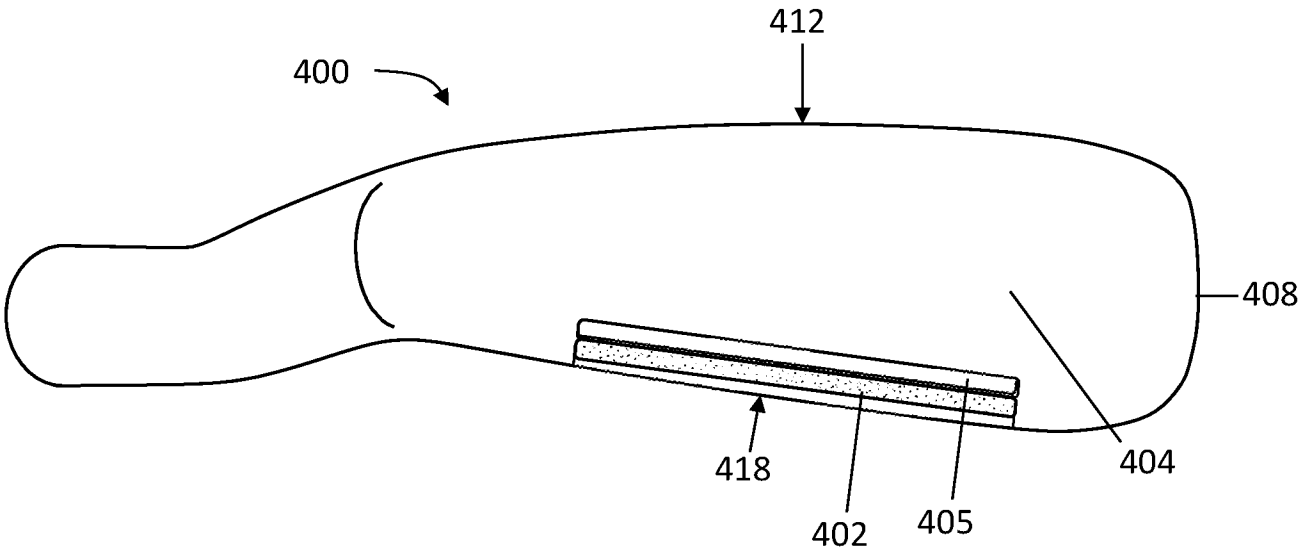
FIG. 4B depicts a bottom view of the golf club head of FIG. 4A.

FIGS. 4A-4B depict a section view and a bottom view, respectively, of another golf club head 400 and are described concurrently. The golf club head 400 is similar to the golf club heads described above. As such, elements common to the configuration of the golf club head 400 and the golf club heads described above are numbered similarly, but are not necessarily described further. The inner wall structure 402 of the golf club head 400 includes a fixed end 414 and an unfixed end 416. The fixed end 414 may be attached to the sole portion 404, toe portion 408, and/or the heel portion 410, and the unfixed end 416 is received in a recess 407 in the interior portion of the topline 406. In some embodiments, the inner wall structure 402 may be wider than the sole channel 405, and the fixed end 414 of the inner wall structure 402 may be attached to segments of the sole portion 404 that extend outside the sole channel 405 towards the toe portion 408 and the heel portion 410. The striking face 418 has a fixed end at the topline 406 and an unfixed end near the sole portion 404. Accordingly, the inner wall structure 402 may slide against the rear surface of the striking face 418. In some examples, the striking face 418 may also be attached to the toe portion 408 and/or the heel portion 410.

The sole channel 405 is located near the front of the golf club head 400 and separates the inner wall structure 402 and the striking face 418 from the remainder of the sole portion 404. For instance, the front edge 424 of the sole channel 405 is defined by the fixed end 414 of the inner wall structure 402, and the back edge 426 is defined the sole portion 404. By locating the sole channel 405 further towards the front of the golf club head 400, the bottom portion of the striking face 418 is able to more easily deflect, further adding to the ball speed resulting from a strike on the lower portion of the striking face 418. The sole channel 405 may also be filled with or spanned by an elastic material. In some embodiments, a flexible coating may also coat the bottom of the golf club head 400 to cover the edges of the striking face 418 and any external edges of the inner wall structure 402, e.g., so as to prevent wear.

Figure 5A:
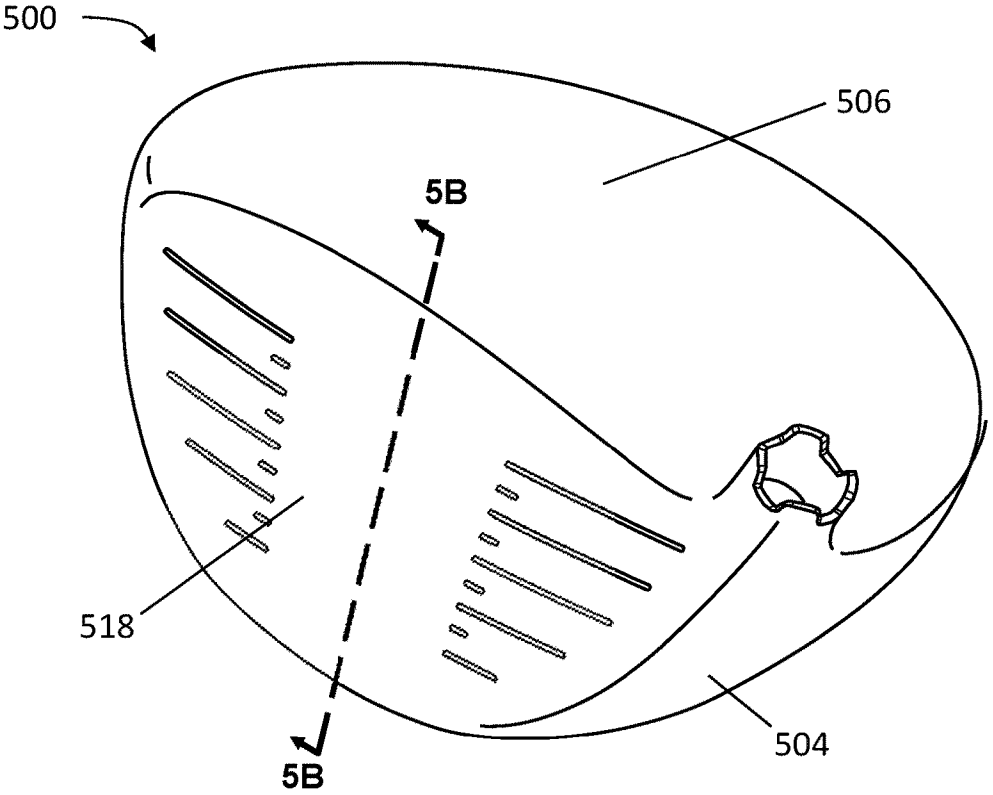
FIG. 5A depicts a perspective view of a golf club head of a driver having a double-walled striking face and a sole channel.
Figure 5B:
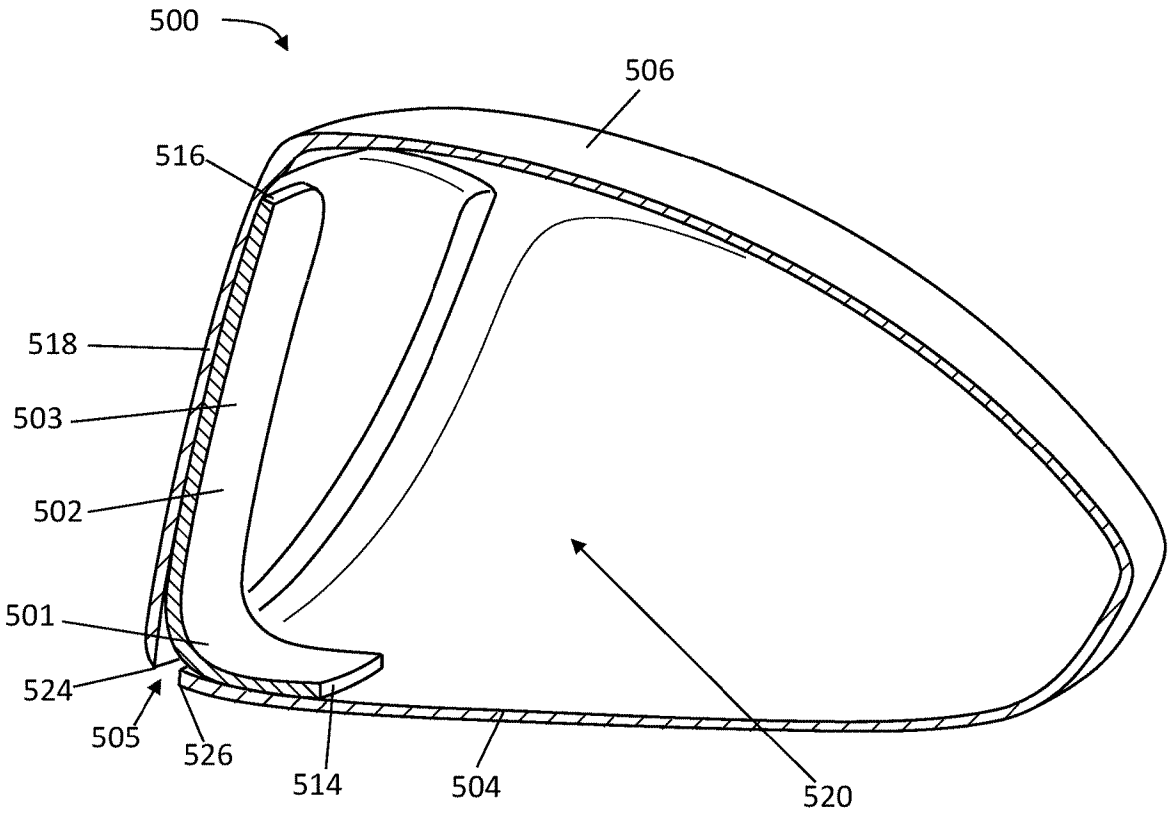
FIG. 5B depicts a section view of the golf club head of FIG. 5A.
Figure 5C:
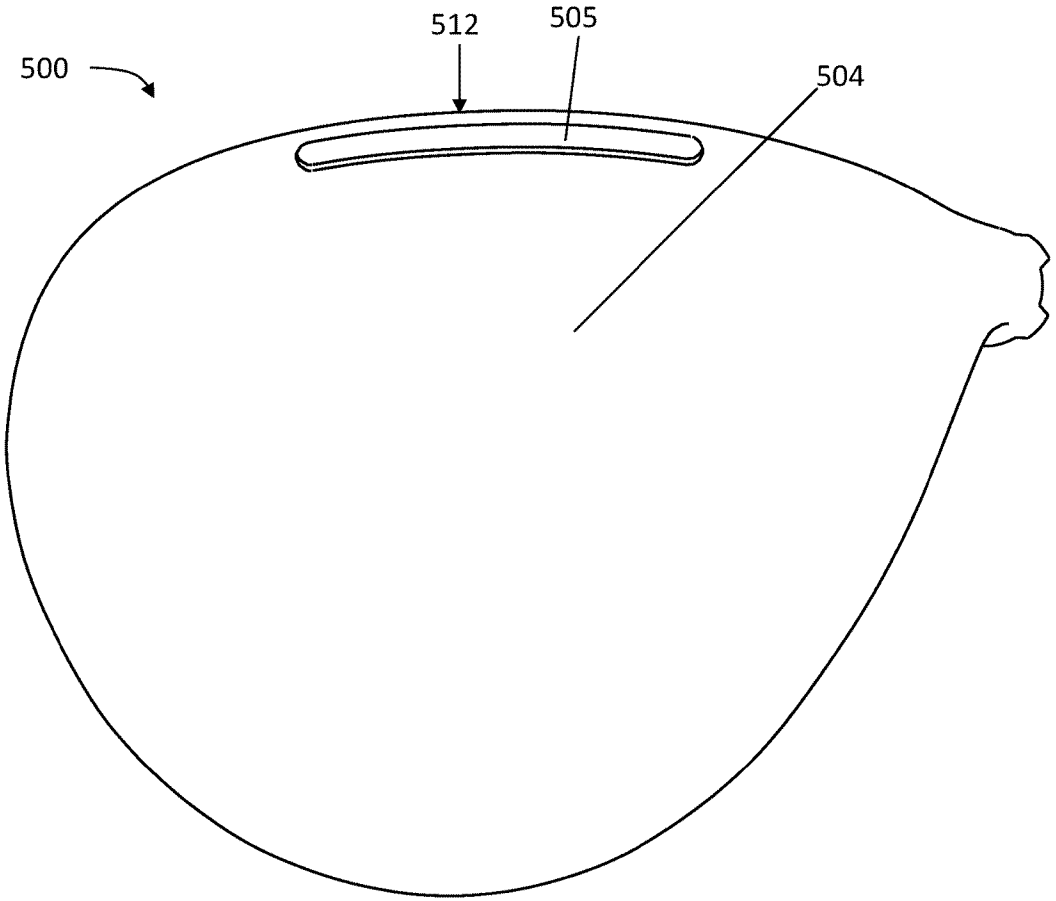
FIG. 5C depicts a bottom view of the golf club head of FIGS. 5A-5B.

FIG. 5A depicts a perspective view of a golf club head 500 of a driver having an inner wall structure 502 and a sole channel 505. FIG. 5B depicts a section view of the golf club head 500, and FIG. 5C depicts a bottom view of the golf club head 500. FIGS. 5A-5C are described concurrently. The golf club head 500 includes a crown 506 and a sole portion 504 attached thereto. The golf club head 500 also includes a striking face 518 attached to the crown 506 and a segment of the sole portion 504. The inner wall structure 502 includes a fixed end 514 attached to the sole portion 504 near the back edge 526 of the sole channel 505. An unfixed end 516 is not fixed to the striking face 518 or the crown 506. In some embodiments, the crown 506 may include a recess (not shown) for receiving the unfixed end 516 of the inner wall structure 502 as with the configurations described above. The inner wall structure 502 also includes a support portion 501 and a contact portion 503. The support portion 501 may be a curved c-shape, a curved s-shape, or some other shape. The contact portion 503 may contact the majority of the rear surface of the striking face 518. In some examples, substantially the entire rear surface of the striking face 518 is backed by the inner wall structure 502. In some embodiments, the striking face 518 and the inner wall structure may be constructed of the same or similar materials as discussed above. Further, the contact portion 103 may be coated with a polymer for managing vibration, sounds properties, and to reduce friction. The golf club head 500 also includes a cavity 520 partially defined (in section) by the sole portion 504, the crown 506, and the inner wall structure 502.

The sole channel 505 is incorporated into the sole portion 504. In the example depicted, the front edge 524 of the sole channel 505 is defined by a bottom edge of the striking face 518, and the back edge 526 of the sole channel 505 is defined by the sole portion 504. Accordingly, the sole channel 505 separates a portion of the striking face 518 from the sole portion 504. The sole channel 505 may have a width substantially the size of a golf ball diameter or larger. In some examples, the sole channel 505 may have a width more than double the size of a golf ball diameter. Many of the benefits and features from the sole channels and inner wall structures discussed above are also applicable to the golf club head 500. Further, while sole channel 505 and the inner wall structure 502 are shown in the golf club head 500 of a driver, such structures may be incorporated into other metal woods, such as fairway metal woods and hybrid clubs.

Figure 6:
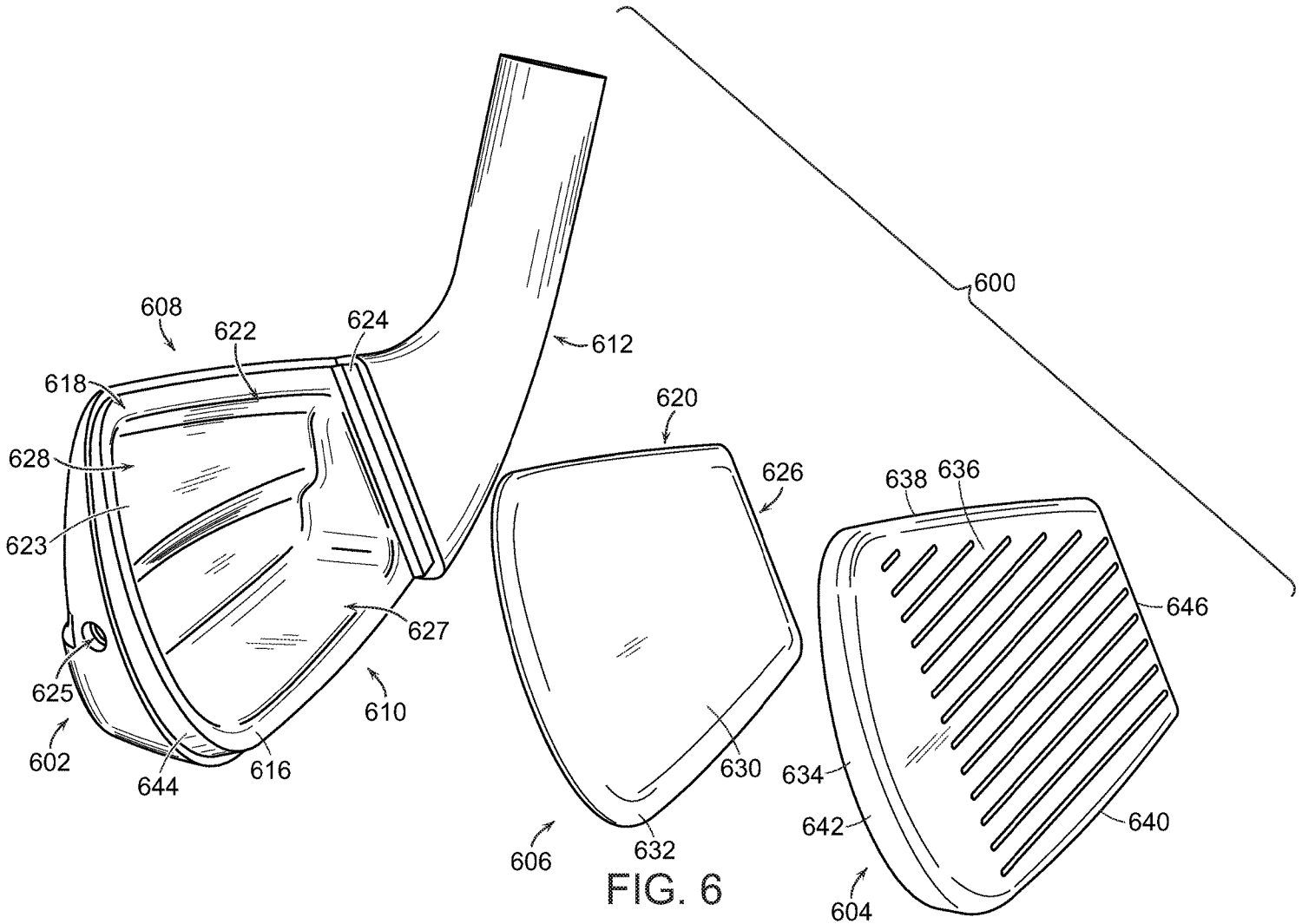
FIG. 6 depicts an exploded perspective view of another example of a golf club head having a back supporting wall.

FIG. 6 depicts an exploded perspective view of another example of a golf club head 600. The golf club head includes a club head body 602, a striking face 604, and an inner wall 606 disposed between the body 602 and striking face 604, as described in more detail herein. The club head body 602 includes a perimeter defined by a topline 608, a sole 610, a heel 612, and a toe 614, as known generally in the art. Further, each of the striking face 604 and inner wall 606 include edges or portions disposed proximate each of the corresponding portions 608, 610, 612, and 614 of the club head body 602. The body 602 includes a ledge 616 that extends inward from the outer perimeter of the body 602. The ledge 616 provides support along one or more edges of the inner wall 606. In the depicted configuration, the ledge 616 is proximate but discrete from the topline 608, sole 610, and toe 614 of the club body 602. In other examples the ledge 616 may extend from each of the topline 608, sole 610, heel 612, and toe 614. In other example, the ledge 616 may extend from only two of those features, which may be generally opposed to each other. The ledge 616 includes a flat, or generally flat, contact surface 618 that contacts a rear surface the inner wall 606, typically proximate an outer perimeter edge 620 thereof. The ledge 616 may also include a curved edge portion 622, which reduces stress on the inner wall 606 as the inner wall 606 deflects during use. The club body 602 may include a rest 624 which may be a raised wall or other feature that may be used to assist in manufacture. For example, a heel edge 626 of the inner wall 606 may be placed in abutting contact with the rest 624 during manufacture to ensure proper positioning thereof. Thereafter, the striking face 604 may be secured to the club body 602 so as to hold the inner wall 606 therein. The topline 608, sole 610, heel 612, toe 614, inner wall 606, and a rear wall 623 may define a void 627 within the golf club head 600. As the inner wall 606 deflects into the void 627 during use, pressure in the void 627 may increase. A pressure relief 625 may be defined by a portion of the club head body 602 and may be covered by a thin flexible film or other membrane to prevent ingress of water or debris, while accommodating pressure changes within the void 627.

The inner wall 606 may be a thin plate, manufactured, for example, of high-strength steel and steel alloys. Example materials include Aermet 320, Aermet 340, and others. The inner wall 606 may have an outer perimeter shape substantially similar to that of the club head body 602 (more specifically, an opening 628 defined generally by the ledge 616 therein), and/or the striking face 604. The inner wall 606 has a central area 630 and an edge area 632 that bounds the central area 630, which is generally flat. The edge area 632 is tapered, such that the outer perimeter edge 620 of the inner wall 606 has a thickness less than that of the central area 630. In examples, the central area 630 may have a thickness of between about 1.75 mm to about 1.35 mm. Central area 630 thicknesses of about 1.75 mm, about 1.65 mm, or about 1.5 mm may be desirable, although other thicknesses are contemplated. The thickness of the inner wall 606 at the outer perimeter edge 620 may be between about 1.35 mm to about 0.8 mm. Perimeter edge 620 thicknesses may be about 1.3 mm, about 1.2 mm, or about 1.05 mm. Of course, the thickness at the outer perimeter edge 620 is less than that at the central portion 630. The tapered edge area 632 allows the inner wall 606 to deflect during striking of a golf ball, without applying a force to the striking face 604, thus preventing inadvertent separation thereof from the club body 602. This is depicted in more detail below in FIGS. 10A and 10B.

Relative sizes of the central area 630 and the edge area 632 of the inner wall 606 may be modified as required or desired to affect performance of the golf club head 600. The central area 630 may be defined as the area of the inner wall 606 that contacts a rear surface of the striking face 604 when the golf club head 600 is in the neutral position. The edge area 632 may be defined as the area of the inner wall 606 that does not contact the rear surface of the striking face 604 when the golf club head 600 is in the neutral position. In examples, the central area 630 may represent about 75%, about 78% or about 80% of the total area of a front face of the inner wall 606 (with the edge area representing about 25%, about 22%, and about 20%, respectively, thereof). In general, the larger the central area 630 of the inner wall 606, the greater return force on the striking face 604 during deflection thereof.

The striking face 604 may also be generally flat, but also may include a rim 634 that may extend at least partially around a striking portion 636 of the striking face 604. In this case, the rim 634 is disposed along a topline edge 638, a sole edge 640, and a toe edge 642 of the striking face 604. These edges 638, 640, 642 are secured to a contact rim 644 on the club body 602, so as to secure the striking face 604 to the club body 602. The striking face 604 may be secured to the contact rim 644 via welding, chemical adhesive(s), friction interface(s), etc. In this example, a heel edge 646 of the striking face 604 does not include any portion of the rim 634 and, as such, may be secured to the flat rest 624. The ledge 616 may be generally discrete and extend inward from the contact rim 644. The striking face 604 may have a thickness of about 0.9 mm to about 1.25 mm.

Certain thickness relationships between the striking face 604 and inner wall 606 may produce particularly desirable results. Example thicknesses of each of these components are identified above. For example, it has been determined that particularly desirable models include a ratio of inner wall thickness to the front wall thickness of between about 1.2 and about 1.5. In one particular example, the inner wall 604 has a thickness of about 1.5 mm, while the front wall has a thickness of about 1.25 mm.

Figure 7:
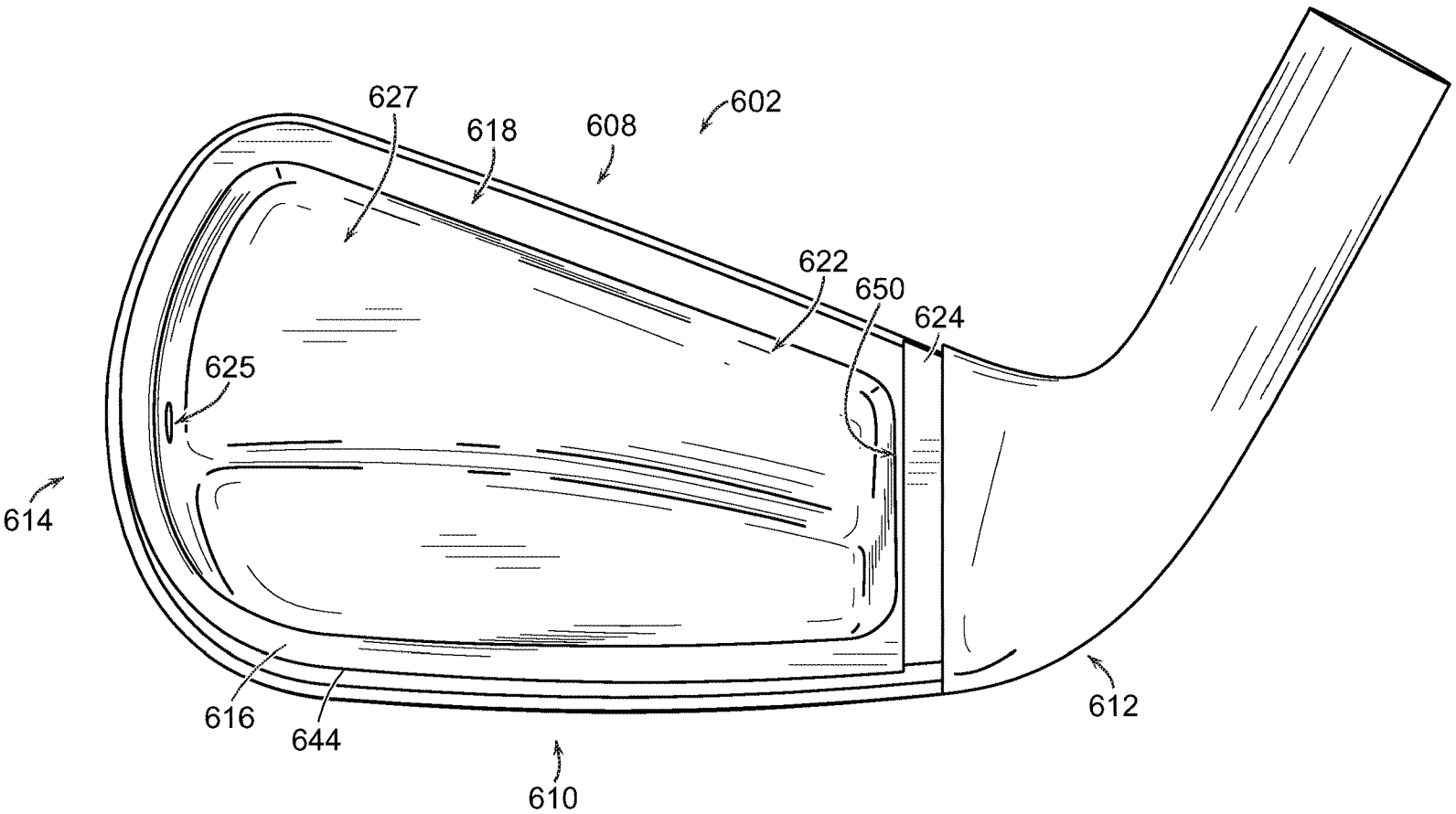
FIG. 7 depicts a front view of the club head body of FIG. 6.

FIG. 7 depicts a front view of the club head body 602 of FIG. 6. A number of features depicted in FIG. 7 are described above in the context of FIG. 6 and, as such, are not necessarily described further. As noted above, the club body 602 includes the ledge 616 that terminates at the curved edge portion 622. The depicted club body 602 includes the ledge 616 proximate each of the topline 608, sole 610, and toe 614. As such, the inner wall (not depicted) is disposed in contact with each of these portions of the ledge 616 (that is, proximate the topline 608, sole 610, and toe 614) when the inner wall is in a neutral (or not deflected) position. As the inner wall deflects into the void 627, the rear surface of the edge thereof contacts the curved edge portion 622. The portion of the inner wall proximate the heel 612 of the club body 602 performs differently, however. As can be seen in FIG. 7, the ledge 616 does not extend proximate the heel 612. As such, the rear surface of the inner wall proximate the heel 612 is unsupported by the ledge 616 when in the neutral (or not deflected) position. As the inner wall deflects, however, the rear surface of the inner wall proximate the heel 612 contacts a lip 650 that extends inward from the heel 612. The lip 650 may be generally continuous with the curved edge portion 622 of the ledge 618. Contact between the rear surface of the inner wall and the lip 650 improves performance of the golf club head. It has been discovered through testing that supporting inner wall about the entire perimeter thereof does not necessarily improve performance of the golf club head. In fact, performance may be significantly improved where the inner wall 606 is supported in the neutral position at the edges disposed proximate the topline 608, sole 610, and toe 614, but not at the heel 612.

Figure 8:
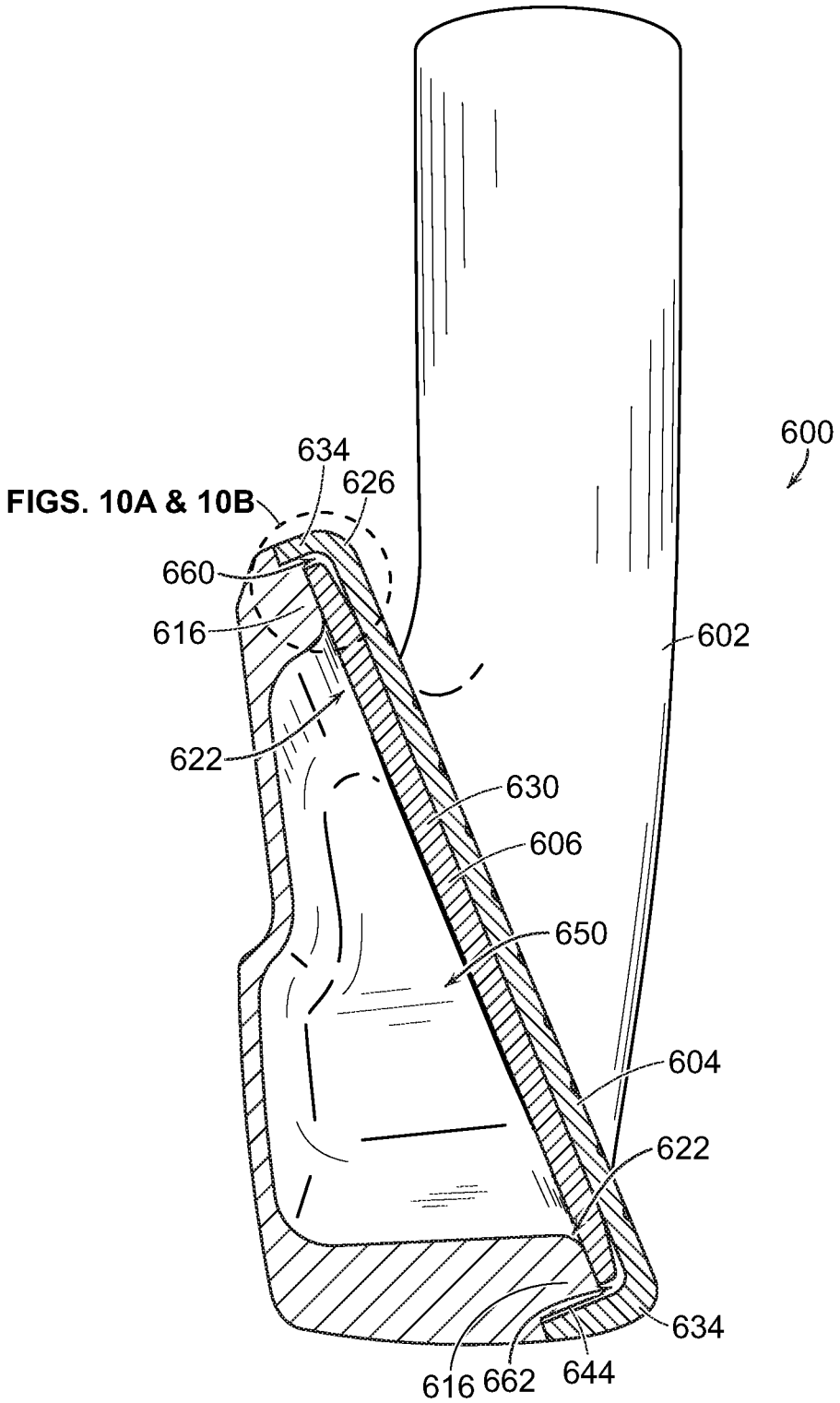
FIG. 8 is a side section view of the golf club head of FIG. 6.

FIG. 8 is a side section view of the golf club head 600 of FIG. 6. A number of features depicted in FIG. 8 are described above in the context of FIGS. 6 and 7 and, as such, are not necessarily described further. When the rim 634 of the striking face 604 is secured to the contact rim 644 of the club head body 602, a gap 660 is formed between the ledge 616 and a rear surface 662 of the striking face 604. The tapered edge area 632 is disposed within this gap 660. When in this configuration, the central area 630 of the inner wall 606 is in contact with the rear surface 662 of the striking face 604. As can be seen in FIG. 8, a front surface of the tapered edge area 632 does not contact the rear surface 662 when in the neutral position. Further, due to the presence of the taper, when the inner wall 606 is in the deflected position (e.g., when the striking face 604 strikes a golf ball and deflects both the striking face 604 and inner wall 606), the tapered outer edge 632 will not apply a responsive force to the rear surface 662 as the edge 632 deflects forward. This is further depicted in FIGS. 10A and 10B, below.

Figure 9:
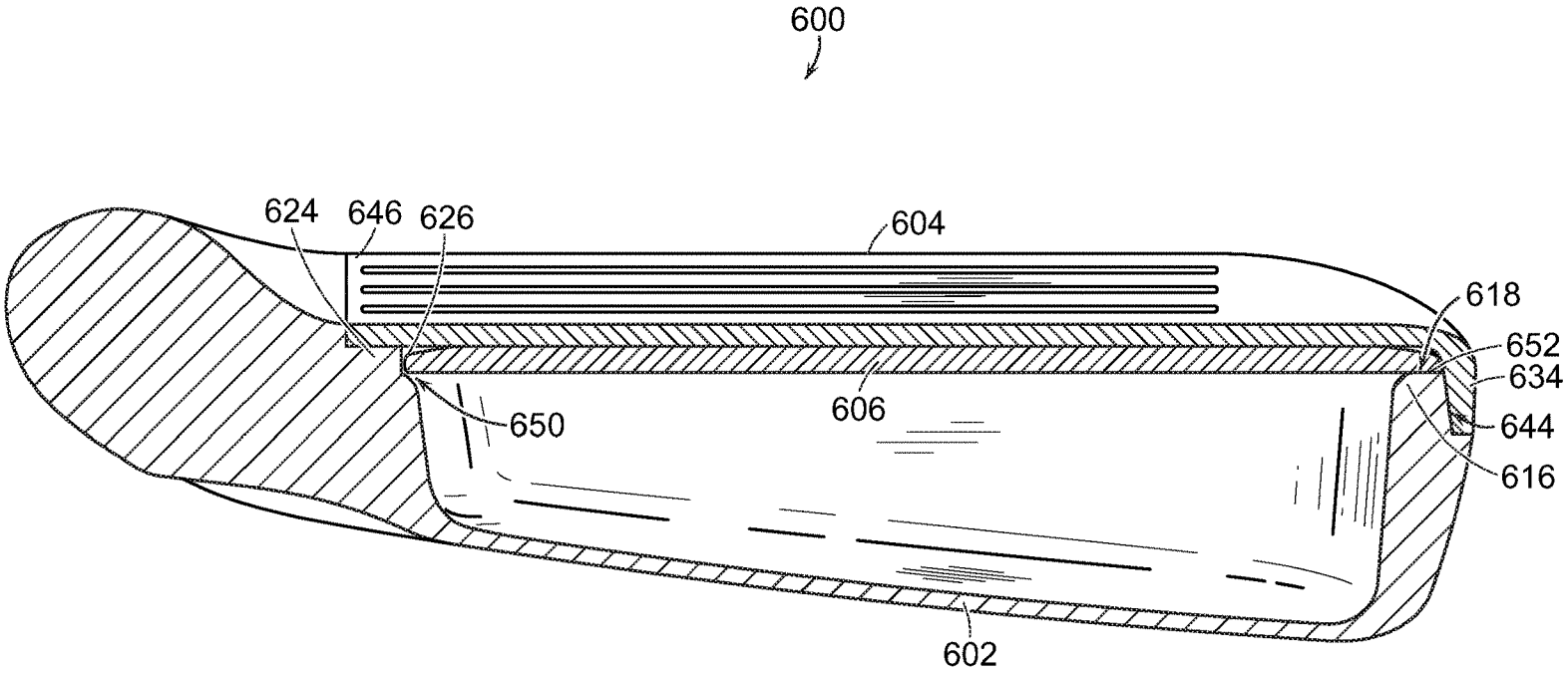
FIG. 9 is a top section view of the golf club head of FIG. 6.

FIG. 9 is a top section view of the golf club head 600 of FIG. 6. A number of features depicted in FIG. 9 are described above in the context of FIGS. 6-8 and, as such, are not necessarily described further. Notably, FIG. 9 depicts the rest 624 which abuts, on a first side, the heel edge 626 of the inner wall 606 and, on a second side, the heel edge 646 of the striking face 604. Further, the lip 650 at the heel edge 626 of the inner wall 606 is depicted. As can be seen, the lip 650 defines a projection considerably less deep than the ledge contact surface 618 disposed on the opposite side of the club body 602. As such, deflection of the heel edge 626 of the inner wall 606 differs from that of the toe edge 652 of the inner wall 606. In that case, varied depths of the ledge 616 may alter performance of a golf club head 600 that utilizes an inner wall 606. In cases, ledges 616 having longer or shorter contact surfaces 618 may be utilized as required or desired for particular applications.

Figure 10A:
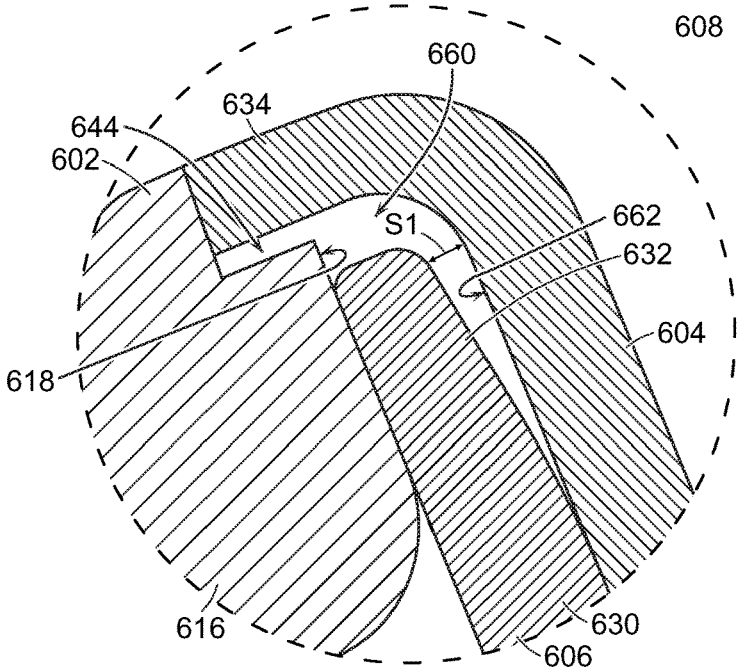
FIGS. 10A and 10B are enlarged partial side section views of the golf club head of FIG. 6 in neutral and deflected positions, respectively.
Figure 10B:
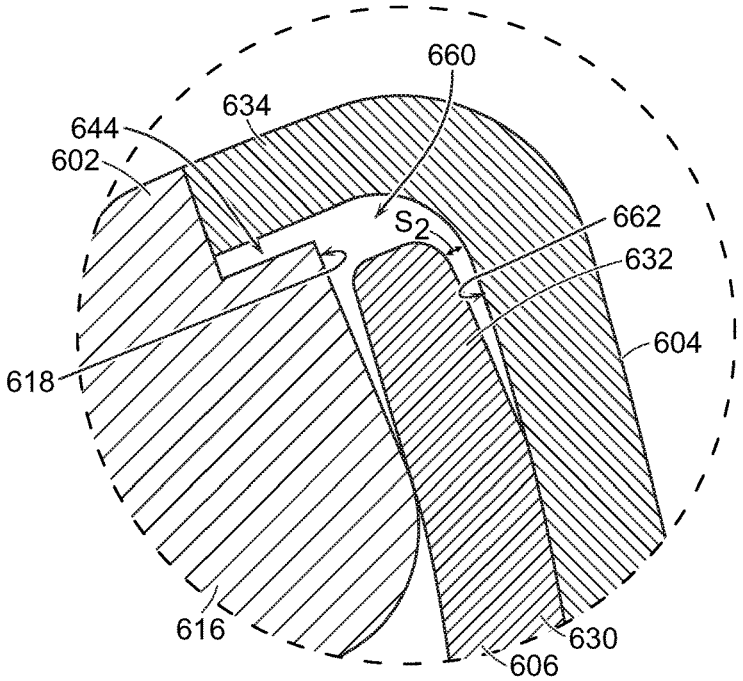

FIGS. 10A and 10B are enlarged partial side section views of the golf club head 600 of FIG. 6 in neutral and deflected positions, respectively. In FIG. 10A, the tapered edge area 632 is depicted in the gap 660 between the rear surface 662 of the striking face 604 and the contact surface 618 of the ledge 616. In the depicted configuration, the rim 634 of the striking face 604 is secured to the contact rim 644 of the club head body 602. The central area 630 of the inner wall 606 is in contact with the rear surface 662 of the striking face 604. In the neutral position, the taper of the edge area 632 defines a first space S1 between the tapered edge surface 632 and the rear surface 662 of the striking face 604. Turning to FIG. 10B, deflection of the striking face 604, e.g., due to contact with a golf ball, is depicted. Since the rear surface 662 of the striking face 604 is in contact with the central portion 630 of the inner wall 604, deflection thereof also deflects the inner wall 604. In response, the tapered edge area 632 disposed about the perimeter of the inner wall 606 deflects forward, towards the rear surface 662 of the striking face 604. This decreases the distance between the tapered edge surface 632 and the rear surface 662 to a space S2, which is less than S1. However, due to the shape of the tapered edge area 632, contact with the rear surface 662 is reduced or eliminated. This prevents application of a force against the rear surface 662, which may help preserve the integrity of the connection between the rim 634 of the striking face 604 and the contact rim 644 of the club head body 602.

Although specific embodiments and aspects were described herein and specific examples were provided, the scope of the technology is not limited to those specific embodiments and examples. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

The invention claimed is:

1. A golf club head comprising:

a striking face;

a club head body comprising a perimeter contact rim and a ledge extending from the perimeter contact rim, wherein the striking face is secured to the club head body proximate the perimeter contact rim, and wherein the ledge is spaced from a rear surface of the striking face so as to define a gap therebetween, and wherein the club head body further comprises a sole, a topline, a heel, and a toe, and wherein the ledge is disposed proximate at least one of the sole, the topline, the heel, and the toe; and an inner wall comprising a perimeter edge, wherein at least a portion of the perimeter edge is disposed in the gap and in contact with the ledge, and wherein the rear surface of the striking face is in contact with a portion of the inner wall, and wherein a heel portion of the perimeter edge is unsupported by the ledge when the striking face is in a neutral position.

2. The golf club head of claim 1, wherein the ledge extends inward from the perimeter contact rim, and wherein the ledge is offset from the perimeter contact rim, and wherein the inner wall is substantially parallel to the striking face.

3. The golf club head of claim 1, wherein the perimeter edge is tapered.

4. The golf club head of claim 1, wherein the perimeter edge is in contact with a portion of the ledge disposed proximate the topline and the sole.

5. The golf club head of claim 1, wherein the heel portion of the perimeter edge is in contact with a lip when the striking face is in a deflected position.

6. The golf club head of claim 1, wherein the perimeter edge of the inner wall has a shape substantially similar to a perimeter edge of the striking face.

7. A golf club head comprising:

a body portion comprising a perimeter contact rim and a ledge extending inward from the at least a portion of the perimeter contact rim, wherein the ledge is discrete from the perimeter contact rim;

an inner plate having an edge and a central portion, wherein at least a portion of the edge is in contact with the ledge; and a striking face secured to the perimeter contact rim, wherein a rear surface of the striking face is in contact with the central portion of the inner plate when the striking face is in a neutral position, wherein the edge of the inner plate is tapered and wherein when in the deflected position, the rear surface of the striking face and the perimeter edge of the inner plate define a space therebetween.

8. The golf club head of claim 7, wherein the rear surface of the striking face is in contact with the central portion of the inner plate when the striking surface is in a deflected position.

9. The golf club head of claim 7, wherein the inner plate comprises a topline edge, a sole edge, and a heel edge, and wherein when the striking surface is in a neutral position, the topline edge and the sole edge are in contact with the ledge.

10. The golf club head of claim 9, wherein when the striking surface is in a deflected position, (a) the topline edge and the sole edge are in contact with the ledge, and (b) the heel edge is in contact with a lip extending from the club head body.

11. The golf club head of claim 7, wherein the striking face is secured about the perimeter contact rim.

12. The golf club head of claim 7, wherein the body portion comprises a topline edge, a sole edge, a heel edge, and a toe edge, and wherein the ledge extends along substantially the entire length of at least one of the topline edge, the sole edge, the heel edge, and the toe edge.

13. The golf club head of claim 12, wherein the ledge comprises two ledges, wherein the two ledges are disposed proximate opposing edges of the perimeter contact rim.

14. A golf club head comprising:

a club head body comprising a perimeter contact rim and a ledge extending inward from at least two opposing edges of the perimeter contact rim;

a striking face connected to the club head body proximate the perimeter contact rim; and an inner wall comprising a central portion defining a central area and an edge surrounding the central portion and defining an edge area less than the central area, wherein the edge is in contact with the ledge, and wherein a rear surface of the striking face contacts the central portion and is spaced apart from the edge when the striking face is in both a neutral position and a deflected position.

15. The golf club head of claim 14, wherein a distance between the edge and the rear surface of the striking face in the neutral position is greater than a distance between the edge and the rear surface of the striking face in the deflected position.

16. The golf club head of claim 14, wherein the central area comprises an area approximately 78% of the a total area of the inner wall.

17. The golf club head of claim 14, wherein the striking face and the inner wall comprise substantially similar perimeter shapes.

* * * * *